US007891184B2

(12) United States Patent
Gimsa

(10) Patent No.: US 7,891,184 B2
(45) Date of Patent: Feb. 22, 2011

(54) 4-CYCLE STIRLING MACHINE WITH TWO DOUBLE-PISTON UNITS

(76) Inventor: Andreas Gimsa, Fliederhang 5, OT Wilhelmshorst, 14557 Michendorf (DE)

( * ) Notice: Subject to any disclaimer, the term of this patent is extended or adjusted under 35 U.S.C. 154(b) by 326 days.

(21) Appl. No.: 12/063,720

(22) PCT Filed: Oct. 7, 2005

(86) PCT No.: PCT/DE2005/001833

§ 371 (c)(1),
(2), (4) Date: May 5, 2008

(87) PCT Pub. No.: WO2007/019815

PCT Pub. Date: Feb. 22, 2007

(65) Prior Publication Data

US 2010/0139262 A1 Jun. 10, 2010

(30) Foreign Application Priority Data

Aug. 16, 2005 (DE) ..... 10 2005 039 417
Sep. 5, 2005 (DE) ..... 10 2005 042 744

(51) Int. Cl.
*F01B 29/08* (2006.01)
*F01K 25/00* (2006.01)
*F01B 29/10* (2006.01)
*F02G 1/04* (2006.01)

(52) U.S. Cl. ..... 60/517; 60/516; 60/525; 60/526

(58) Field of Classification Search ..... 60/516–526; 62/6, 520

See application file for complete search history.

(56) References Cited

U.S. PATENT DOCUMENTS

| | | | | |
|---|---|---|---|---|
| 2,480,525 | A * | 8/1949 | Van Weenen | 60/525 |
| 3,751,904 | A * | 8/1973 | Rydberg | 60/525 |
| 4,620,418 | A * | 11/1986 | Fujiwara et al. | 60/517 |
| 4,760,698 | A * | 8/1988 | Bartolini et al. | 60/526 |

FOREIGN PATENT DOCUMENTS

| | | |
|---|---|---|
| AU | 472315 | 8/1975 |
| DE | 3834071 | 4/1990 |
| DE | 10060137 | 5/2002 |
| GB | 682445 | 11/1952 |

* cited by examiner

*Primary Examiner*—Thomas E Denion
*Assistant Examiner*—Christopher Jetton
(74) *Attorney, Agent, or Firm*—Fay Kaplun & Marcin, LLP

(57) ABSTRACT

A 4-cycle Stirling engine is for carrying out thermal power processes or heat power and cold and heat pumping processes with two double piston units which move with a phase offset to each other.

2 Claims, 1 Drawing Sheet

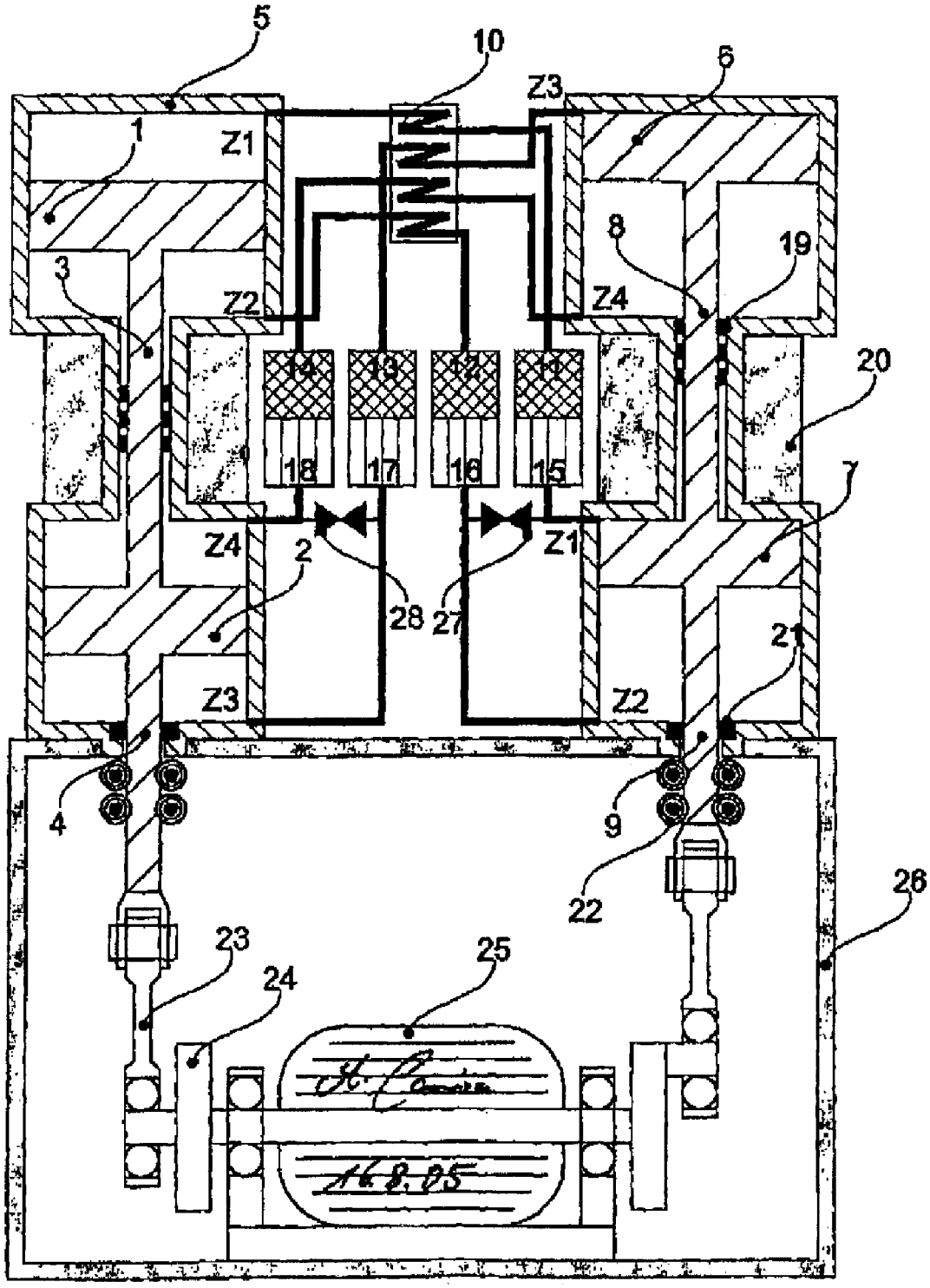
Figur 1

4-CYCLE STIRLING MACHINE WITH TWO DOUBLE-PISTON UNITS

STATE OF THE ART

Double-acting Stirling motors are known in different variations of the Siemens arrangement. With these motors, 4 cylinders lie next to one another and these in each case have an expansion space and a compression space.

DESCRIPTION

The invention describes a 4-cycle Stirling motor (4CS) of the alpha type, with two double-piston units, which move to one another with a phase shift, in each case consisting of 2 pistons which are connected to one another with piston rods (3), (8), and of piston rod extensions (4), (9) which are mechanically connected to one another via a gear.

A double-piston unit may consist of an expansion piston and a compression piston, two expansion pistons or two compression pistons.

The cycle connections according to FIG. 1 are created such that each cycle may execute a Stirling motor process. In FIG. 1, the expansion takes place with the downwards movement of the first double-piston unit and with the trailing second double-piston unit in the cycle 1, the compression in the cycle 2, the isochoric supply of heat in cycle 3 and the isochoric removal of heat in the cycle 4. The course of the torque force on the crank shaft is very balanced and positive throughout on account of this.

In the inventive arrangement according to FIG. 1, the cylinder space below the piston 1 is connected to the cylinder space below piston 7 via a first heater-regenerator-cooler assembly, and the cylinder space above piston 1 is connected to the cylinder space above piston 7 via a second heater-regenerator-cooler assembly. Additionally, the cylinder space above the piston 6 is connected to the cylinder space below the piston 2 via a third heater-regenerator-cooler assembly and the cylinder space below the piston 6 is connected to the cylinder space above the piston 2 via the third heater-regenerator-cooler assembly.

Since in each case the first piston of a double-piston unit may be used as a guide for the second one, there exits the possibility of operating without piston rings with a defined annular gap.

The double-acting piston of the double-piston units, taking into account the respective temperature level and pressure level, may be realized as membranes or bellows which may be used on both sides, preferably in an outer, pressure-tight enclosure wall.

The cylinders for the pistons (1), (2), (6) and (7) may differ from one another in their diameters. By way of this, for example the expansion spaces may be designed larger than the compression spaces. Furthermore, by way of varying the cylinder diameter, one may carry out a system optimization with the simultaneous realisation of process running clockwise or anti-clockwise (see below for description).

One may apply a heater with which 4 single-tube spirals lying one after the other or 4 single-tube spirals wound in pairs, are arranged in a hollow cast base body. The combustor may be located within the cast base body.

For subjecting the regenerator matrix of thinner working gas connection tubes of the 4-CS to a uniform onflow, a flow body may be installed in front of the matrix, which has a low flow resistance on both sides, uniformly distributes the gas and is preferably a ball.

In order to permit a simple exchange of the seals in the respective cylinder centre, this may be designed in the form of piston rings (19) on the piston rods (3) and (8).

The cycle bypass valves (27) and (28) may be used for the closed-loop control of the participating cycles in part load operation.

The following advantages result when compared to a 4-cycle Siemens-Stirling motor A more simple gearing and less mechanical friction Low mixing losses of the working gas Low thermal conduction losses, in particular in the region of the cylinder wall.

A more compact construction

Variation possibility of the expansion space with respect to the compression space One further arrangement according to the invention is a 4-cycle universal machine with two double-piston units which move with a phase shift to one another, with which 2 cycles are used for preparing mechanical energy and the two remaining cycles are used for cooling the heat sources and heating the heat sinks.

For this, the four working gas regions of the heater in FIG. 1 are reduced to two, specifically those of cycle 1 and cycle 2. The remaining working gas region of the heat-addition in cycle 3 and 4, which are then no longer in the heater (locally and thermally separated), are thermally connected to one or two heat sources. The regions of the heat-removal of cycle 3 and 4 (cooler regions) may be connected to one or two heat sinks. Thus for example, one may construct a cooler machine which with the excess of mechanical energy of cycle 1 and 2, realises cooling processes in the two other cycles. Of course, alternatively the cycles 3 and 4 may be used for providing mechanical energy, and cycle 1 and 2 for the cooling processes. The alternative application of a heat pump instead of a cooler machine also goes without saying. One may construct a machine which for example uses cycle 1 and 2 as thermal power processes, cycle 3 as a cooler machine and cycle 4 as a heat pump. For this, the working gas regions of the heat-addition of cycle 3 and cycle 4 must be thermally separated on account of the different temperature levels.

The machine may also be configured such that the cylinder space above the piston 1 is connected to the cylinder space above piston 6 via the first heater-regenerator-cooler assembly, and that the cylinder space below the piston 1 is connected to the cylinder space below the piston 6 via the second heater-regenerator-cooler assembly. Additionally, the cylinder space above the piston 2 is connected to the cylinder space above the piston 7 via the first heat source-regenerator-heat sink assembly, and the cylinder space below the piston 2 is connected to the cylinder space below the piston 7 via the second heat source-regenerator-heat sink assembly.

A further arrangement of the machine according to the invention lies in connecting the cylinder space above the piston 1 to the cylinder space below the piston 7 via the first heater-regenerator-cooler assembly, and connecting the cylinder space below the piston 1 to the cylinder space above the piston 7 via the second heater-regenerator-cooler assembly. Additionally, the cylinder space above the piston 2 is connected to the cylinder space below the piston 6 via the first heat source-regenerator-heat sink assembly, and the cylinder space below the piston 2 is connected to the cylinder space above the piston 6 via the second heat source-regenerator-heat sink assembly An advantageous coupling of two 4-cycle machines is achieved if in each case a further double-piston unit of a 4-cycle cooler machine is articulated onto the two cranks of the crank shaft for two double-piston units of a 4-cycle motor.

A smoothly running machine with a large output, good separation of the different temperature levels and a simple gearing is achieved by way of this.

Advantages

One may operate 4 processes in one rotation direction with the described arrangements 4 clockwise heat-power processes or 4 anti-clockwise cooler machine processes or heat pump processes, or 2 clockwise and 2 anti-clockwise processes For example, simple cooler machines which are solar or powered by vegetable oil and with comparatively high efficiencies may also be constructed in the part load range. The COP of thermally operated conventional systems only lies between 0.5 and 1.1 (compared to compression installations in the region of 3.5 to 4.5 COP).

The machine may provide mechanical, electrical or thermal energy as well as refrigeration. With a variation of the design, components of a certain energy form may be adapted to the type of use.

A gearing for achieving the phase shift and for energy conversion may also be realized in the form of a linear generator-linear motor system. For this, magnet bodies or coil bodies are fastened on the piston rod extensions, which interact with outer, stationary coil bodies or magnet bodies. The energy excess of the one double-piston unit may be utilised in this manner, in order to drive the other double-piston unit. Thereby, the linear generator-linear motor systems permanently alternate between generator operation and motor operation.

A linear generator-linear motor system in combination with the arrangement of the two double position units in Boxer form is advantageous. The moving and stationary coil bodies and magnet bodies of both double-piston units may then be partly or completely unified. A V-arrangement with a connection to only one common crank shaft crank may also be realised apart from the arrangement of the double-piston units according to FIG. 1 and the Boxer form.

LIST OF REFERENCE NUMERALS

1 expansion piston of the first double-piston unit
2 compression piston of the first double-piston unit
3 piston rod of the first double-piston unit
4 piston rod extension of the first double-piston unit
5 cylinder housing
6 expansion piston of the second double-piston unit
7 compression piston of the second double-piston unit
8 piston rod of the second double-piston unit
9 piston rod extension of the second double-piston unit
10 4-cycle heater
11 regenerator cycle 1
12 regenerator cycle 2
13 regenerator cycle 3
14 regenerator cycle 4
15 cooler cycle 1
16 cooler cycle 2
17 cooler cycle 3
18 cooler cycle 4
19 piston rod rings for sealing
20 thermal insulation
21 piston rod seal
22 linear guide
23 con-rod
24 crank shaft
25 generator
26 crank housing
27 cycle bypass valve cycle 1 with cycle 2
28 cycle bypass valve cycle 3 with cycle 4
Z1 cycle 1
Z2 cycle 2
Z3 cycle 3
Z4 cycle 4

The invention claimed is:

1. A 4-cycle Stirling machine of an alpha type, comprising: first and second double-piston units being moved to one another with a phase shift, wherein each of the double-piston units includes (a) a double-acting expansion piston being firmly connected to a double-acting compression piston via a piston rod and (b) a piston rod extension being firmly connected at a first end to the compression piston, the piston rod extension being mechanically connected to a gear at a second end and wherein a generator is positioned between the piston rod extensions of the double-piston units, wherein a first cylinder space above the first expansion piston is connected to a second cylinder space above the second compression piston via a first heater-regenerator-cooler assembly, wherein a third cylinder space below the first expansion piston is connected to a fourth cylinder space below the second compression piston via a second heater-regenerator-cooler assembly, wherein the fifth cylinder space above the second expansion piston is connected to the sixth cylinder space below the first compression piston via a third heat source-regenerator-cooler assembly, and wherein the seventh cylinder space below the second expansion piston is connected to the eighth cylinder space above the first compression piston via a fourth heat source-regenerator-heat sink assembly.

2. The machine according to claim 1, wherein a crank shaft acts as a generator shaft.

* * * * *